US009061340B2

(12) United States Patent
Lee et al.

(10) Patent No.: US 9,061,340 B2
(45) Date of Patent: Jun. 23, 2015

(54) MOLD FOR HOT STAMPING

(71) Applicant: Sungwoo Hitech Co., Ltd., Busan (KR)

(72) Inventors: Mun Yong Lee, Busan (KR); Young-Ju Lee, Yangsan-si (KR)

(73) Assignee: SUNGWOO HITECH CO., LTD., Busan (KR)

( * ) Notice: Subject to any disclaimer, the term of this patent is extended or adjusted under 35 U.S.C. 154(b) by 350 days.

(21) Appl. No.: 13/629,649

(22) Filed: Sep. 28, 2012

(65) Prior Publication Data

US 2013/0305802 A1 Nov. 21, 2013

(30) Foreign Application Priority Data

May 16, 2012 (KR) ..... 10-2012-0052034

(51) Int. Cl.

*B21D 37/16* (2006.01)
*B21D 22/02* (2006.01)
*B21D 35/00* (2006.01)

(52) U.S. Cl.

CPC ..... *B21D 37/16* (2013.01); *B21D 22/022* (2013.01); *B21D 35/006* (2013.01)

(58) Field of Classification Search

CPC ..... B21D 37/16; B21D 22/02; B21D 22/022; B21D 35/006
USPC ..... 72/342.1, 342.2, 342.3, 342.4, 342.5, 72/342.6; 148/637, 664, 661, 658, 647, 148/644, 654
See application file for complete search history.

(56) References Cited

U.S. PATENT DOCUMENTS

| | | | | |
|---|---|---|---|---|
| 8,047,037 | B2 * | 11/2011 | Vehof et al. | 72/60 |
| 8,127,449 | B2 * | 3/2012 | Bayer et al. | 29/897.2 |
| 8,215,147 | B2 * | 7/2012 | Horton et al. | 72/342.3 |
| 8,381,562 | B2 * | 2/2013 | Schroth et al. | 72/342.1 |
| 8,555,507 | B2 * | 10/2013 | Lee et al. | 29/897.2 |
| 8,631,675 | B2 * | 1/2014 | Gosmann | 72/342.3 |
| 2003/0000275 | A1 * | 1/2003 | Spence et al. | 72/342.1 |
| 2008/0289393 | A1 * | 11/2008 | Lee | 72/342.2 |
| 2012/0234069 | A1 * | 9/2012 | Matsumoto et al. | 72/342.1 |
| 2013/0111966 | A1 * | 5/2013 | Takasue et al. | 72/360 |
| 2013/0240189 | A1 * | 9/2013 | Huang et al. | 165/168 |
| 2014/0096583 | A1 * | 4/2014 | Cho | 72/332 |
| 2014/0260493 | A1 * | 9/2014 | Yoon | 72/342.5 |

FOREIGN PATENT DOCUMENTS

| | | | |
|---|---|---|---|
| JP | 2005-171276 | | 6/2005 |
| JP | 2005171276 | A * | 6/2005 |
| JP | 2011-083812 | | 4/2011 |
| JP | 2011083812 | A * | 4/2011 |
| KR | 10-2008-0103300 | | 11/2008 |

* cited by examiner

*Primary Examiner* — Livius R Cazan
*Assistant Examiner* — John S Lowe
(74) *Attorney, Agent, or Firm* — Lexyoume IP Meister, PLLC

(57) ABSTRACT

A mold for hot stamping is disclosed. The mold for hot stamping according to an exemplary embodiment of the present invention may include an upper mold and a lower mold so as to stamp a heated blank having a welding portion. A recess may be formed at an upper forming surface in the upper mold corresponding to the welding portion of the blank and may define a cooling space between the recess and the blank such that a cooling fluid directly cools the welding portion of the blank after the blank is stamped.

21 Claims, 7 Drawing Sheets

MOLD FOR HOT STAMPING

CROSS-REFERENCE TO RELATED APPLICATION

This application claims priority to and the benefit of Korean Patent Application No. 10-2012-0052034 filed in the Korean Intellectual Property Office on May 16, 2012, the entire contents of which are incorporated herein by reference.

BACKGROUND OF THE INVENTION (a) Field of the Invention

The present invention relates to a mold for hot stamping. More particularly, the present invention relates to a mold for hot stamping that enhances cooling efficiency and improves strength of a welding portion by improving a cooling method of the welding portion when stamping a heated TWB boron steel plate that is a blank for the hot stamping.

(b) Description of the Related Art

Generally, a vehicle body including a bumper beam of a vehicle is manufactured by pressing steel plates, and strength of the steel plates has a great influence on stability of the vehicle.

Recently, hot stamping has often been applied so as to meet high strength and light weight conditions of the steel plates. According to the hot stamping, a boron steel plate 111 is stamped in a hot state, as shown in FIG. 1.

The boron steel plate 111 is a steel plate containing a small amount of boron (element symbol "B"). In the boron steel plate 111, boron atoms are segregated at austenite grain boundaries at an appropriate temperature condition so as to lower free energy of the austenite grain boundaries. Therefore, generation of free ferrites is suppressed so as to greatly improve hardenability of steel (depth to which steel is hardened due to formation of martensite when quenching).

The hot stamping of the boron steel plate 111 will be briefly described.

The boron steel plate 111 with a ferrite crystal structure having tensile strength of about 500-800 MPa is heated up to 900° C. such that a boron steel plate 111 with an austenite crystal structure is formed, and the heated boron steel plate 111 with an austenite crystal structure is stamped in hot stamping molds 113 and 115. After that, the boron steel plate 111 with an austenite crystal structure is quickly cooled at a cooling speed of about 27° C./s-30° C./s such that a high-strength product with a martensite crystal structure having tensile strength of about 1300-1600 MPa is manufactured.

Such a hot stamping product 117 is four or five times as strong as and thinner than a product manufactured by another method using a steel plate. Therefore, weight may be reduced by up to 40% compared with a conventional product, and accordingly, a vehicle body having high strength but light weight can be manufactured.

The hot stamping can achieve high strength and light weight of the product, but manufacturing cost may be very high if the product is manufactured with only the boron steel plate 111.

Particularly, high strength is not needed at all parts but only at specific parts of the product used in the vehicle body.

Therefore, the hot stamping product has recently been manufactured by using a tailor welded blank (hereinafter called "TWB") including the boron steel plate when manufacturing the vehicle body.

That is, a TWB 200 including the boron steel plate (hereinafter called "TWB boron steel plate") has a part demanding high strength and another part. In this case, the one part is manufactured with the boron steel plate and the other part is manufactured with a ductile steel plate. The TWB boron steel plate 200 is manufactured by welding the boron steel plate and the ductile steel plate together. On the contrary, the TWB boron steel plate 200 may be manufactured with only boron steel plates, as shown in FIG. 2. In this case, the part demanding high strength is manufactured with a thick boron steel plate 111*a* and the other part is manufactured with a thin boron steel plate 111*b*. At this time, the TWB boron steel plate 200 is manufactured by welding the thick boron steel plate 111*a* and the thin boron steel plate 111*b* together.

Such a TWB boron steel plate 200 is also stamped once in the hot stamping molds 113 and 115 after being heated up to 900° C. by a heater. After that, the TWB boron steel plate 200 is quickly cooled (with a cooling speed of about 27° C./s-30° C./s) by an indirect cooling method due to heat conduction of the hot stamping molds 113 and 115 themselves such that a high-strength product is manufactured.

Herein, the indirect cooling method means a cooling method where the hot stamping molds 113 and 115 are cooled by a coolant circulating through coolant pathways formed in the hot stamping molds 113 and 115. That is, after a blank (i.e., TWB boron steel plate) at a high temperature is stamped in the molds, the coolant is supplied to the coolant pathways in the molds in a state in which the blank contacts the molds such that the blank is cooled by heat conduction.

According to the hot stamping, the temperature condition (higher than or equal to about 900° C.) is important but the cooling condition (27° C./s-30° C./s) is also important so as to secure strength of the manufactured boron steel plate 111.

If the TWB boron steel plate 200 manufactured with the boron steel plates 111*a* and 111*b* having different thicknesses is used as the hot stamping blank, a surface of a welding portion W of the TWB boron steel plate 200 is rough or has an irregular surface gradient due to a welding bead WB. Therefore, it is impossible to manufacture a forming surface of the mold so as to correctly match the welding portion W of all the blanks.

Since the welding portion W cannot completely contact the hot stamping molds 113 and 115, and particularly the upper mold 113, cooling efficiency of the welding portion W using heat conduction may be deteriorated.

As described above, it is hard to meet the cooling condition of the TWB boron steel plate 200 manufactured with the boron steel plates 111*a* and 111*b* having different thicknesses due to deterioration of cooling efficiency at the welding portion W after the hot stamping. Therefore, it is difficult to secure strength of the welding portion W.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a mold for hot stamping having advantages of enhancing cooling efficiency and securing strength of a welding portion by simultaneously using an indirect cooling method due to heat conduction of a TWB boron steel plate and a direct cooling method where a cooling fluid is directly injected to the welding portion.

A mold for hot stamping according to an exemplary embodiment of the present invention may stamp a heated blank having a welding portion.

The mold for hot stamping may include: a lower mold having a lower forming surface formed at an upper surface thereof; an upper mold having an upper forming surface formed at a lower surface thereof and a supply line and an exhaust line formed therein, wherein a recess is formed at the upper forming surface corresponding to the welding portion of the blank and that defines a cooling space between the recess and the blank; a supply control valve mounted at a side surface of the upper mold and adapted to supply a cooling fluid to the cooling space through the supply line; an exhausting device mounted at the other side surface of the upper mold and adapted to exhaust the cooling fluid from the cooling space through the exhaust line; a temperature detecting device mounted in the upper mold, detecting a temperature of the upper mold near the cooling space, and outputting a temperature signal; and a controller controlling the supply control valve and the exhausting device depending on the temperature signal output from the temperature detecting device.

The cooling fluid may be a coolant.

The cooling fluid may be air.

The upper mold may have an upper die and a lower die assembled with each other, laying recesses may be respectively formed at confronting surfaces of the upper die and the lower die, and a coolant pipe may be laid in the laying recesses.

The coolant pipe may be formed with a repeating "S" shape.

The cooling space may be the recess having a predetermined width formed at the upper forming surface of the lower die of the upper mold along the welding portion of the blank.

The supply control valve may be mounted at the side surface of the upper mold, and may connect the supply line in the upper mold with an exterior cooling fluid supply line.

The supply control valve may be an electric control solenoid valve of an on/off type.

The exhausting device may be a pump.

The exhausting device may be a fan.

The temperature detecting device may include: a sensor block inserted in a mounting groove formed from the side surface of the upper mold to a proximity of the cooling space; a temperature sensor engaged to an inner end of the sensor block so as to contact an interior surface of the mounting groove and electrically connected to the controller; a return spring mounted at the inner end of the sensor block and supported by the interior surface of the mounting groove; and a fixing bar neighboring the mounting groove, mounted at the side surface of the upper mold by a pin, and supporting an outer end of the sensor block.

The controller may include a control logic operating the supply control valve and the exhausting device when the temperature signal of the temperature detecting device is higher than or equal to a predetermined value.

The blank having the welding portion may be a tailor welded blank manufactured by welding boron steel plates having different thicknesses together.

A mold for hot stamping according to another exemplary embodiment of the present invention may include an upper mold and a lower mold so as to stamp a heated blank having a welding portion.

A recess may be formed at an upper forming surface in the upper mold corresponding to the welding portion of the blank and may define a cooling space between the recess and the blank such that a cooling fluid directly cools the welding portion of the blank after the blank is stamped.

The cooling fluid is a coolant.

The cooling fluid is air.

The upper mold may have an upper die and a lower die assembled with each other, laying recesses may be respectively formed at confronting surfaces of the upper die and the lower die, and a coolant pipe may be laid in the laying recess.

The coolant pipe may be formed with a repeating "S" shape.

The cooling space may be the recess having a predetermined width formed at the upper forming surface of the lower die of the upper mold along the welding portion of the blank.

The mold for hot stamping may further include: a supply control valve mounted at a side surface of the upper mold and adapted to supply a cooling fluid to the cooling space; an exhausting device mounted at the other side surface of the upper mold and adapted to exhaust the cooling fluid from the cooling space; a temperature detecting device mounted in the upper mold, detecting a temperature of the upper mold near the cooling space, and outputting a temperature signal; and a controller controlling the supply control valve and the exhausting device depending on the temperature signal output from the temperature detecting device.

The upper mold may further include a supply line formed therein

The supply control valve may be mounted at the side surface of the upper mold, and may connect the supply line in the upper mold with an exterior cooling fluid supply line.

The supply control valve may be an electric control solenoid valve of an on/off type.

The exhausting device may be a pump.

The exhausting device may be a fan.

The temperature detecting device may include: a sensor block inserted in a mounting groove formed from the side surface of the upper mold to a proximity of the cooling space; a temperature sensor engaged to an inner end of the sensor block so as to contact an interior surface of the mounting groove and electrically connected to the controller; a return spring mounted at the inner end of the sensor block and supported by the interior surface of the mounting groove; and a fixing bar neighboring the mounting groove, mounted at the side surface of the upper mold by a pin, and supporting an outer end of the sensor block.

The controller may include a control logic operating the supply control valve and the exhausting device when the temperature signal of the temperature detecting device is higher than or equal to a predetermined value.

The blank having the welding portion may be a tailor welded blank manufactured by welding boron steel plates having different thicknesses together.

<Description of Symbols>

Figure 1:
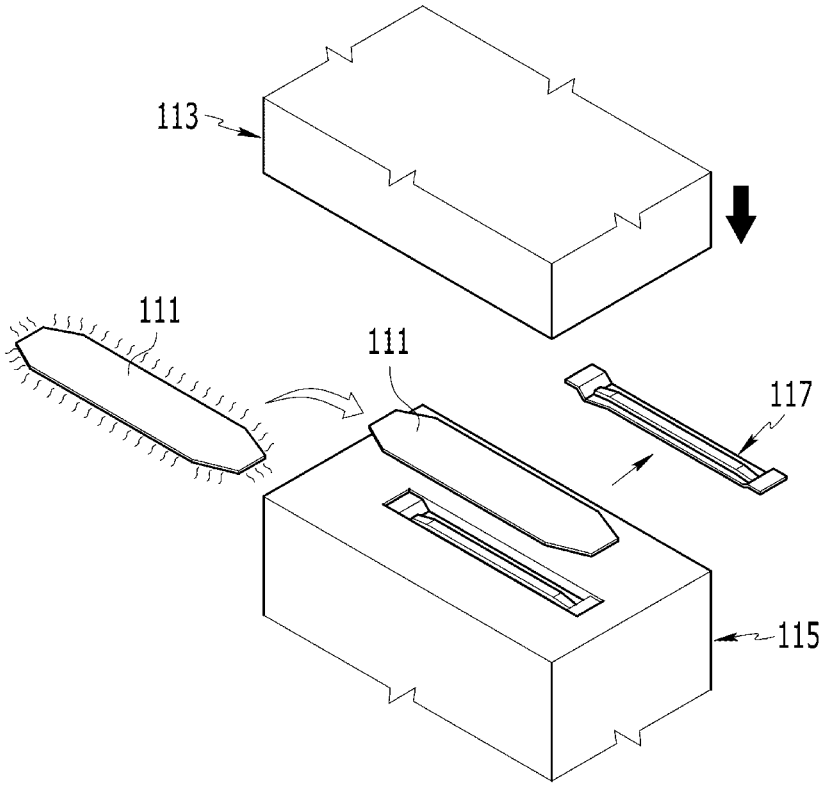
FIG. 1 is a schematic diagram for showing a conventional hot stamping method.
Figure 2:
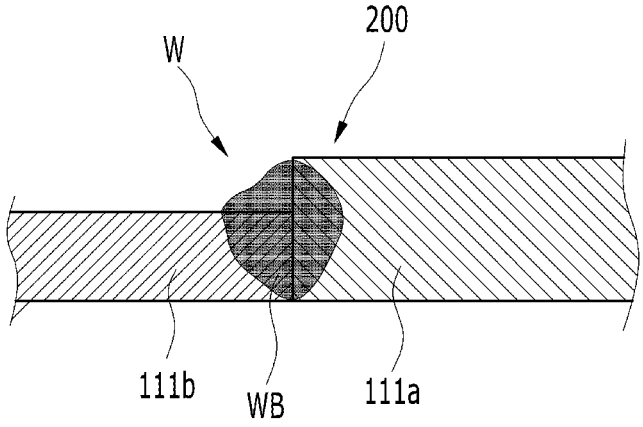
FIG. 2 is a cross-sectional view of a welding portion of a tailor welded blank (TWB) manufactured with boron steel plates having different thicknesses.

| | |
|---|---|
| 1, 3: boron steel plate | 11: lower mold |
| 13: upper mold | 15: upper die |
| 17: lower die | 21: supply control valve |
| 31: exhausting device | 41: temperature detecting device |
| 43: sensor block | 45: temperature sensor |
| 47: return spring | 49: fixing bar |
| 51: controller | 5: TWB boron steel plate |
| W: welding portion | S: cooling space |
| L: coolant pipe | L1: supply line |
| L2: exhaust line | L3: cooling fluid supply line |

DETAILED DESCRIPTION OF THE EMBODIMENTS

The present invention will hereinafter be described with reference to the accompanying drawings.

Since size and thickness of each component illustrated in the drawings are arbitrarily represented for ease of explanation, the present invention is not limited to the drawings. Thicknesses of many parts and regions are enlarged.

In addition, description of components that are not necessary for explaining an exemplary embodiment of the present invention will be omitted.

Figure 3:
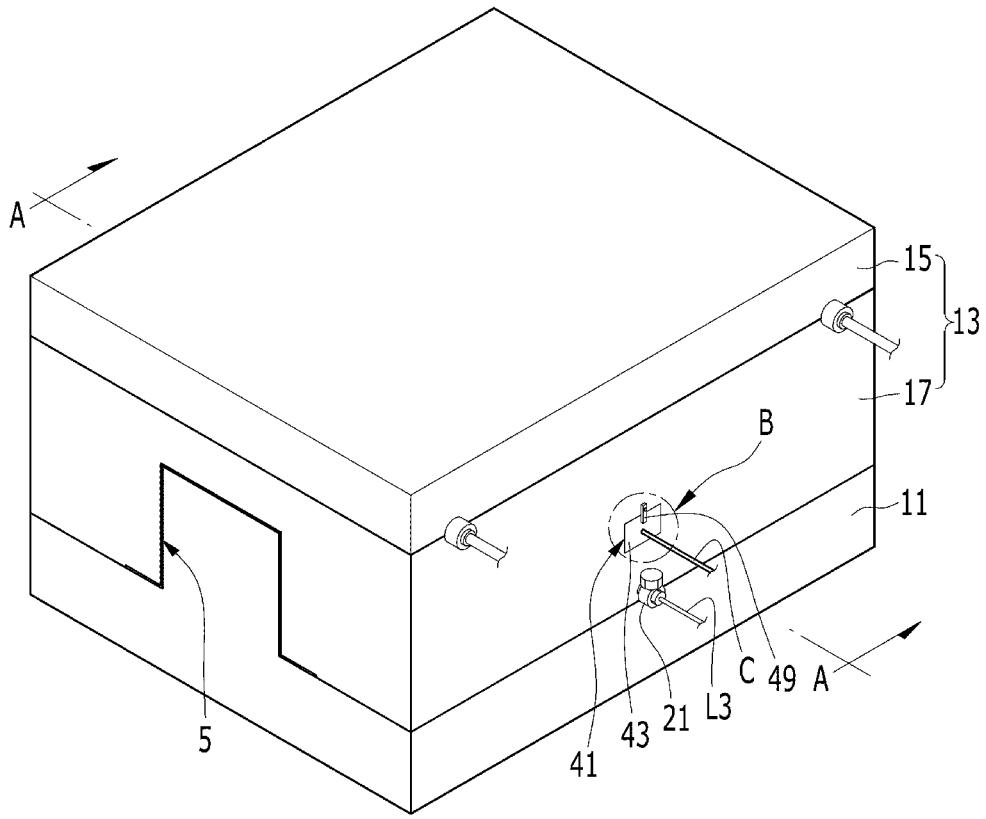
FIG. 3 is a perspective view of a mold for hot stamping according to an exemplary embodiment of the present invention.
Figure 4:
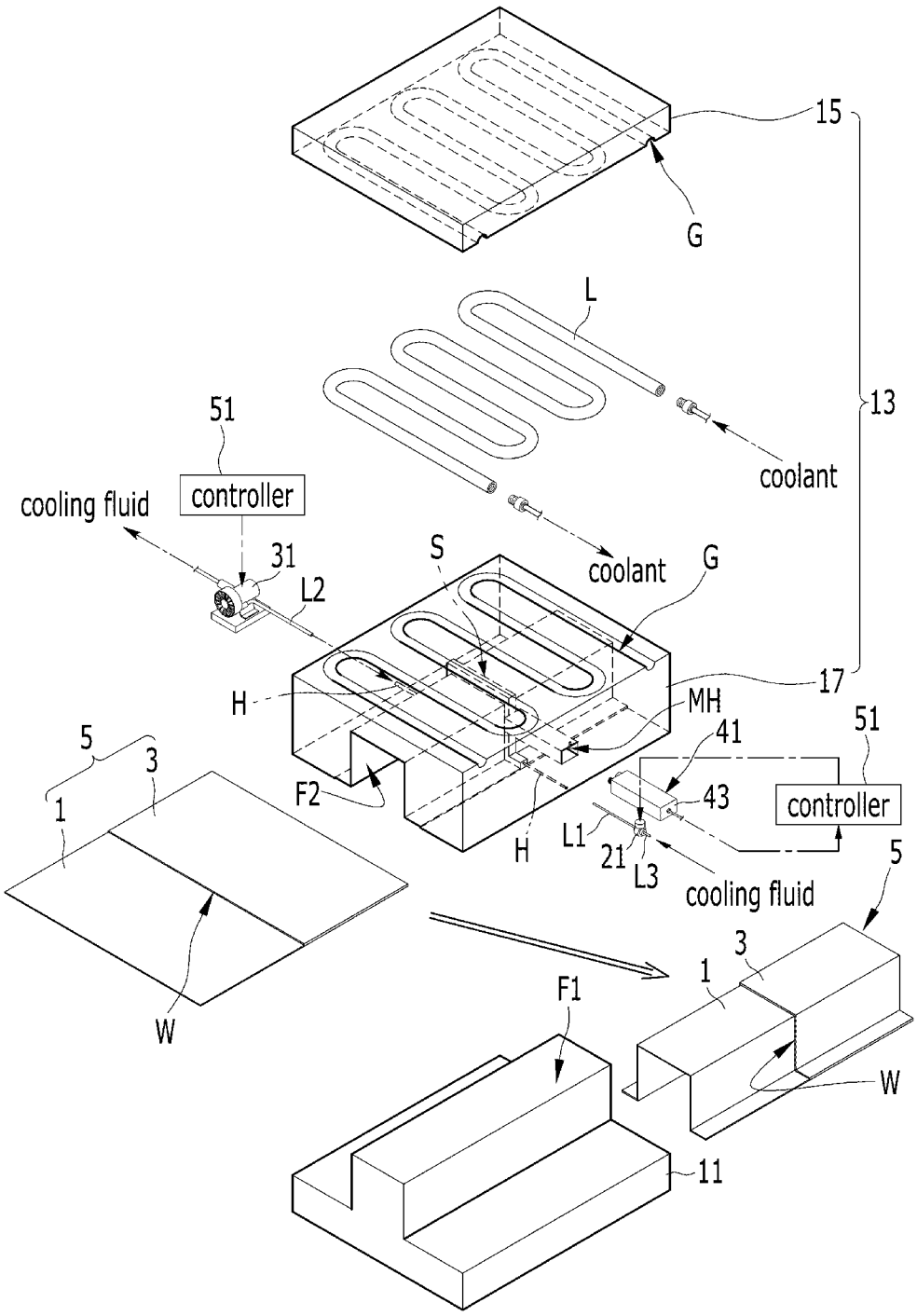
FIG. 4 is an exploded perspective view of a mold for hot stamping according to an exemplary embodiment of the present invention.

FIG. 3 is a perspective view of a mold for hot stamping according to an exemplary embodiment of the present invention, and FIG. 4 is an exploded perspective view of the mold for hot stamping according to an exemplary embodiment of the present invention.

Referring to FIG. 3 and FIG. 4, a mold for hot stamping according to an exemplary embodiment of the present invention is used for a hot stamping process in which boron steel plates are used as blanks.

Particularly, the mold for hot stamping according to an exemplary embodiment of the present invention uses a tailor welded blank (TWB) as a blank. In the TWB, a part demanding high strength and another part are manufactured respectively with boron steel plates 1 and 3 having different thicknesses, and the boron steel plates 1 and 3 having different thicknesses are welded to each other.

According to the hot stamping, the boron steel plate with a ferrite crystal structure having tensile strength of about 500-800 MPa is heated up to 900° C. such that a boron steel plate with an austenite crystal structure is formed, and the heated boron steel plate with an austenite crystal structure is stamped in a mold for hot stamping according to an exemplary embodiment of the present invention. After that, the boron steel plate with an austenite crystal structure is quickly cooled at a cooling speed of about 27° C./s-30° C./s such that a high-strength product with a martensite crystal structure having tensile strength of about 1300-1600 MPa is manufactured.

The mold for hot stamping according to an exemplary embodiment of the present invention is applied to the hot stamping process, and includes a lower mold 11 and an upper mold 13. In addition, the mold for hot stamping further includes a supply control valve 21, an exhausting device 31, a temperature detecting device 41, and a controller 51.

The lower mold 11 has a lower forming surface F1 formed at an upper surface thereof, and the upper mold 13 has an upper forming surface F2 formed at a lower surface thereof and corresponding to the lower forming surface F1.

Figure 5:
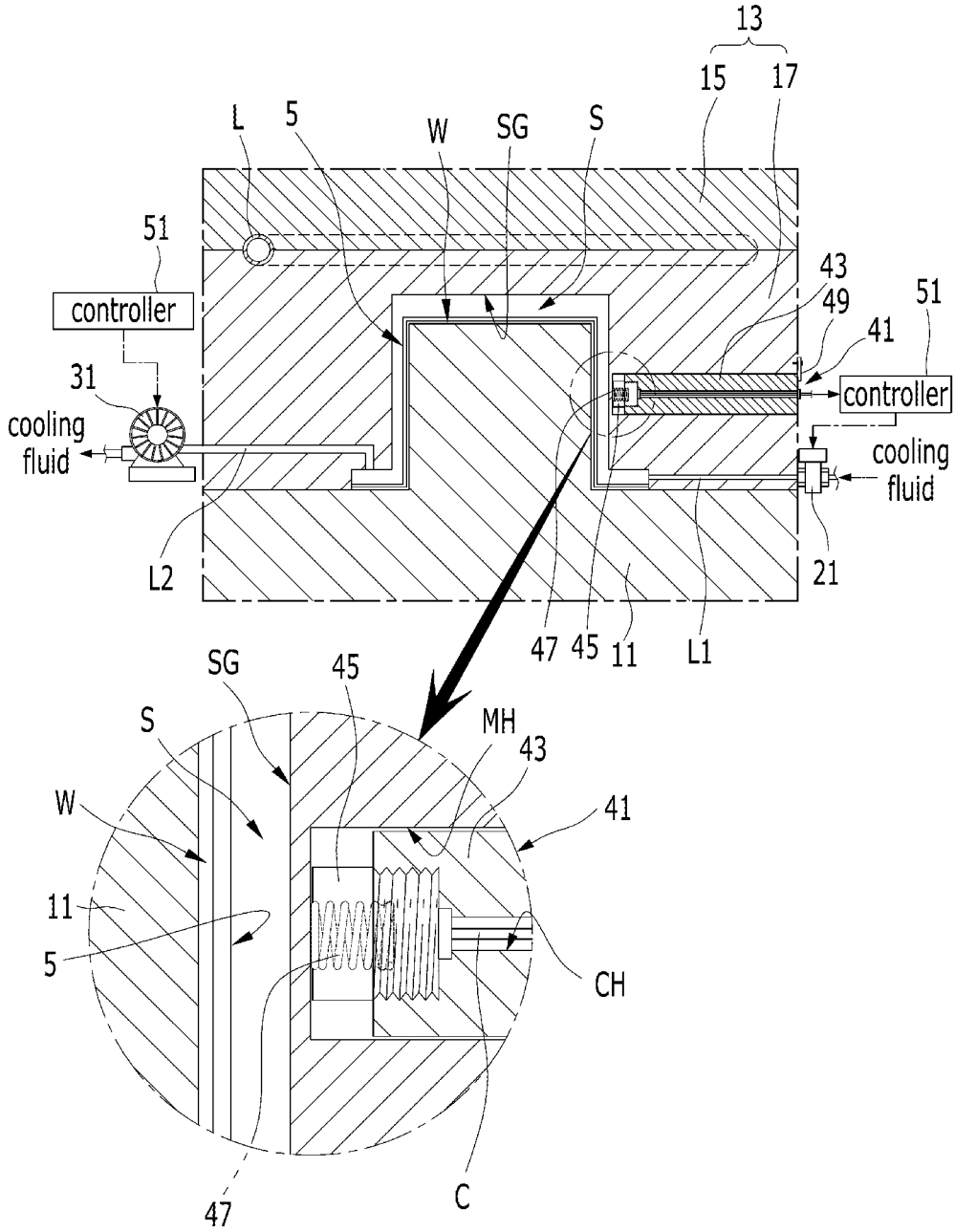
FIG. 5 is a cross-sectional view taken along the line A-A in FIG. 3.

Referring to FIG. 4 and FIG. 5, a recess is formed at a part of the upper forming surface F2 of the upper mold 13. The recess is formed at a position corresponding to a welding portion W of TWB boron steel plate 5, which is manufactured by welding the boron steel plates 1 and 3 having different thicknesses (hereinafter called "TWB boron steel plate") together, and defines a cooling space S between the recess and the TWB boron steel plate 5.

The upper mold 13 is manufactured by assembling an upper die 15 and a lower die 17 with each other, and laying recesses G are formed respectively at confronting surfaces of the upper die 15 and the lower die 17. A coolant pipe L forming a main coolant line is laid in the laying recess G.

Herein, the coolant pipe L is formed with repeating "S" shapes. However, a shape of the coolant pipe L is not limited to the "S" shape, and the coolant pipe may have various shapes considering cooling efficiency.

In addition, the cooling space S is the recess SG having a predetermined width formed at the upper forming surface F2 of the lower die 17 of the upper mold 13 along the welding portion W of the TWB boron steel plate 5.

Referring to FIG. 4 and FIG. 5, the supply control valve 21 is mounted at a side surface of the lower die 17 of the upper mold 13, and is controlled to supply a cooling fluid to the cooling space S through a supply line L1 formed in the lower die 17.

That is, the supply control valve 21 is mounted at the side surface of the lower die 17 so as to connect the supply line L1 in the lower die 17 with an exterior cooling fluid supply line L3.

The supply control valve 21 may be an electrically controlled solenoid valve of on/off type, but is not limited thereto.

In addition, the supply line L1 may be a penetration hole H formed in the lower die 17 so as to connect the side surface of the lower die 17 with the cooling space S. In addition, the supply line L1 may a supply pipe inserted in the penetration hole H.

Herein, the cooling fluid may be a coolant or air.

Referring to FIG. 5, the exhausting device 31 is mounted at the other side surface of the lower die 17 and is adapted to exhaust the cooling fluid from the cooling space S to the exterior through an exhaust line L2 in the lower die 17.

The exhausting device 31 may be a pump or a fan so as to draw in and exhaust steam in a case that the cooling fluid is the coolant or high temperature air in a case that the cooling fluid is air.

Herein, the exhaust line L2 may also be a penetration hole H formed in the lower die 17 so as to connect the other side surface of the lower die 17 with the cooling space S. In addition, the exhaust line L2 may be an exhaust pipe inserted in the penetration hole H.

Referring to FIG. 5, the temperature detecting device 41 is mounted at the side surface of the lower die 17 of the upper mold 13, detects a temperature of the mold near the cooling space S, and outputs a temperature signal.

In order to mount the temperature detecting device 31 in the lower die 17, a mounting groove MH is formed from the side surface of the lower die 17 to a proximity of the cooling space S and a sensor block 43 is inserted into the mounting groove MH.

A cable hole CH is formed in the sensor block 43, and a temperature sensor 45 is engaged at an inner end of the sensor block 43.

The temperature sensor 45 contacts an interior surface of the mounting groove MH so as to detect the temperature of the mold near the cooling space S of the lower die 17, and outputs a temperature signal to the controller 51 connected thereto through a cable C.

At this time, the cable C electrically connects the temperature sensor 45 with the exterior controller 51 through the cable hole CH of the sensor block 43.

In addition, return springs 47 are mounted at both sides of the inner end of the sensor block 43 such that the sensor block 43 is elastically supported by an interior surface of the mounting groove MH. The return spring 47 applies elastic force so as to always push the sensor block 43 from the mounting groove MH.

Figure 6:
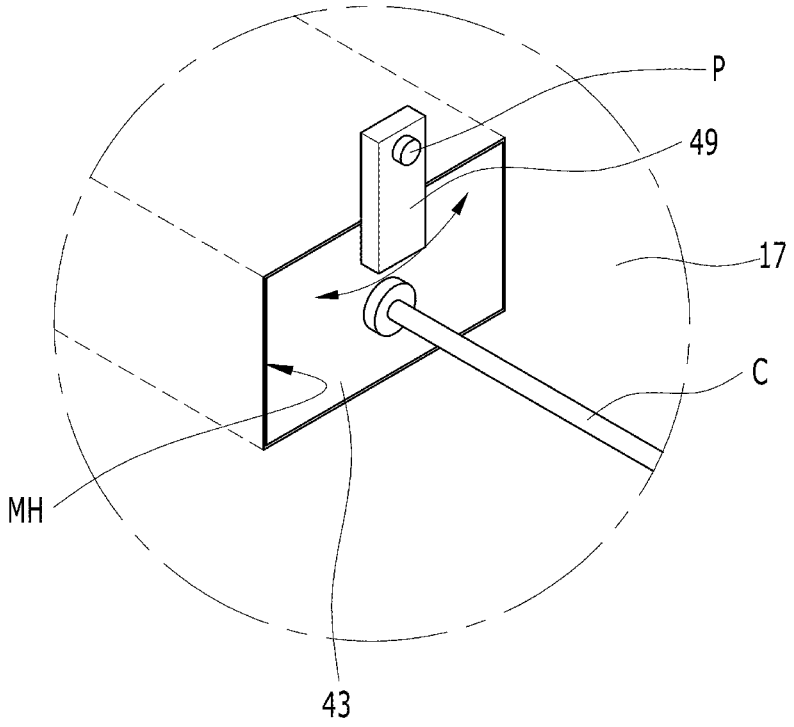
FIG. 6 is an enlarged projected view of a B region in FIG. 3.

In addition, a fixing bar 49 neighboring the mounting groove MH is rotatably mounted through a pin P at the side surface of the lower die 17. Referring to FIG. 6, the fixing bar 49 supports an outer end of the sensor block 43 so as to fix the sensor block 43 to not escape from the lower die 17.

That is, the fixing bar 49 supports the outer end of the sensor block 43 that is pushed from the mounting groove MH by the elastic force of the return spring 47, and prevents separation of the sensor block 43 from the lower die 17.

In addition, if the temperature sensor 45 requires replacement, the fixing bar 49 is rotated about the pin P such that the fixing bar 49 does not support the sensor block 43. In this case, the sensor block 43 is pushed out from the mounting groove MH by the elastic force of the return spring 47.

In addition, the controller 51 controls operations of the supply control valve 21 and the exhausting device 31 according to the temperature signal of the temperature sensor 45.

That is, the controller 51 includes a control logic operating the supply control valve 21 and the pump or the fan that is the exhausting device 31 if the temperature signal of the temperature sensor 45 is higher than or equal to a predetermined value.

Hereinafter, cooling of the welding portion W of the TWB boron steel plate 5 using the mold for hot stamping will be described, referring to FIG. 7.

Figure 7:
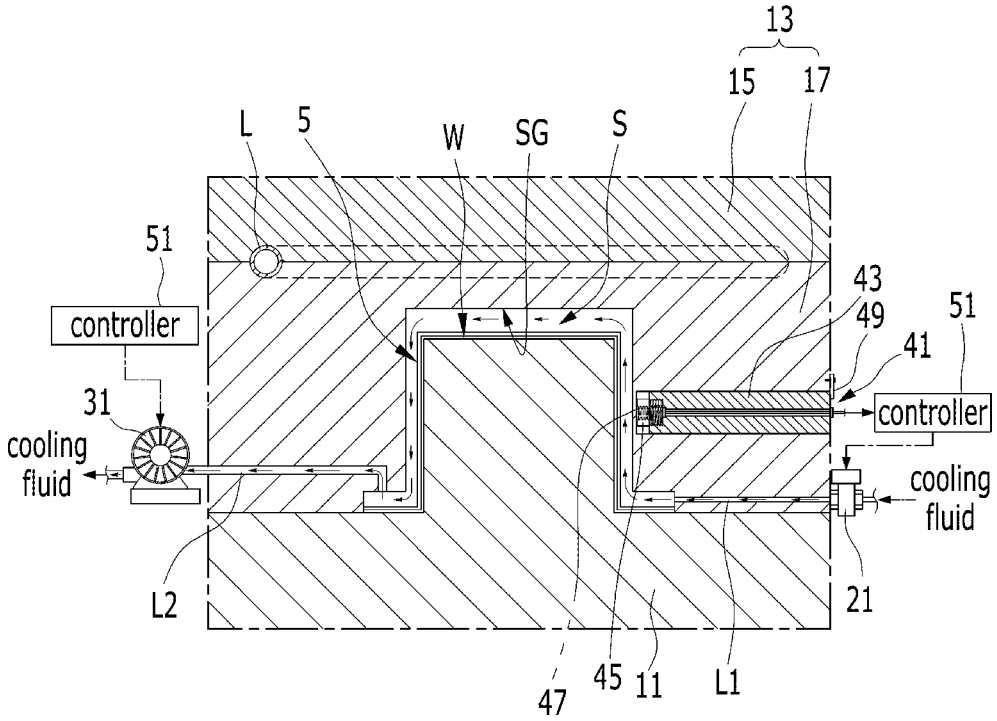
FIG. 7 is a cross-sectional view for showing a cooling method of a mold for hot stamping according to an exemplary embodiment of the present invention.

FIG. 7 is a cross-sectional view for showing a cooling method of a mold for hot stamping according to an exemplary embodiment of the present invention.

The TWB boron steel plate 5 is heated up to 900° C. by the heater and is stamped in the hot stamping mold. After that, the TWB boron steel plate 5 is quickly cooled (with a cooling speed of about 27° C./s-30° C./s) by an indirect cooling method due to heat conduction of the hot stamping mold itself such that high-strength product can be manufactured.

That is, after the TWB boron steel plate 5 having the welding portion W is heated up to 900° C. by the heater (not shown), the TWB boron steel plate 5 is loaded into the lower mold 11.

After that, the upper mold 13 moves downwardly with a predetermined speed and stamps the heated TWB boron steel plate 5 together with the lower mold 11.

At this time, the upper mold 13 as well as the lower mold 11 contacts the TWB boron steel plate 5 at a high temperature and is cooled by the coolant passing through the coolant pipe L in the upper mold 13. In this case, the TWB boron steel plate 5 is quickly cooled with a cooling speed of about 27° C./s-30° C./s by an indirect cooling method due to heat conduction.

Simultaneously, the temperature of the lower die 17 near the cooling space S corresponding to the welding portion W of the TWB boron steel plate 5 rises, and the temperature sensor 45 detects the temperature of the lower die 17 so as to output the temperature signal to the controller 51.

At this time, if the temperature signal is higher than or equal to the predetermined value, the controller 51 operates the supply control valve 21 so as to supply the cooling fluid to the cooling space S formed between the upper forming surface F2 of the lower die 17 corresponding to the welding portion W of the TWB boron steel plate 5. In addition, the controller 51 operates the exhausting device 31 so as to exhaust the cooling fluid from the cooling space S.

In this case, the cooling fluid directly contacts the welding portion W of the TWB boron steel plate 5 in the cooling space S and cools the welding portion W quickly.

At this time, if the temperature signal output from the temperature sensor 45 is lower than the predetermined value, the controller 51 sequentially stops the supply control valve 21 and the exhausting device 31 so as to cut off supply of the cooling fluid to the cooling space S. Therefore, cooling speed of the welding portion W of the TWB boron steel plate 5 is substantially the same as that of the other part of the TWB boron steel plate 5.

Herein, the exhausting device 31 is maintained to be operated for one second after the supply control valve 21 is switched off such that remaining steam or high temperature air is completely exhausted.

The hot stamping product that is cooled completely is removed after the upper mold 13 rises.

According to an exemplary embodiment of the present invention, the welding portion W and the other part are respectively cooled by a direct cooling method and an indirect cooling method such that all parts are cooled with an even cooling speed. Therefore, light weight and high strength of the product may be secured.

Particularly, the welding portion W of the TWB boron steel plate 5 is quickly cooled in the cooling space S by the direct cooling method using the cooling fluid. Therefore, strength of the welding portion W can be secured.

According to an exemplary embodiment of the present invention, the TWB boron steel plate manufactured by welding boron steel plates having different thicknesses together is cooled by simultaneously using the indirect cooling method due to heat conduction and the direct cooling method where the cooling fluid is directly injected to the welding portion. Therefore, cooling efficiency of the welding portion may be enhanced and strength of the welding portion may be secured.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A mold for hot stamping that stamps a heated blank having a welding portion, comprising:

a lower mold having a lower forming surface formed at an upper surface thereof;

an upper mold having an upper forming surface formed at a lower surface thereof and a supply line and an exhaust line formed therein, wherein a recess is formed at the upper forming surface corresponding to the welding portion of the blank and that defines a cooling space between the recess and the blank;

a supply control valve mounted at a side surface of the upper mold and adapted to supply a cooling fluid to the cooling space through the supply line;

an exhausting device mounted at the other side surface of the upper mold and adapted to exhaust the cooling fluid from the cooling space through the exhaust line;

a temperature detecting device mounted in the upper mold, detecting a temperature of the upper mold near the cooling space, and outputting a temperature signal; and a controller controlling the supply control valve and the exhausting device depending on the temperature signal output from the temperature detecting device, wherein:

the blank having the welding portion is a tailor welded blank manufactured by welding boron steel plates having different thicknesses together;

the tailor welded blank is hot stamped such that the welding portion is formed at a boundary region of the boron steel plates;

the upper mold has an upper die and a lower die assembled with each other, laying recesses are respectively formed at confronting surfaces of the upper die and the lower die, and a coolant pipe for indirectly cooling the tailor welded blank is laid in the laying recesses;

the cooling space is the recess having a predetermined width formed at the upper forming surface of the lower die of the upper mold along the welding portion of the tailor welded blank; and the cooling fluid is supplied to the cooling space corresponding to the welding portion such that the cooling fluid directly contacts and cools the welding portion of the tailor welded blank in the cooling space after the tailor welded blank is stamped.

2. The mold of claim 1, wherein the cooling fluid is a coolant.

3. The mold of claim 1, wherein the cooling fluid is air.

4. The mold of claim 1, wherein the coolant pipe is formed with a repeating "S" shape.

5. The mold of claim 1, wherein the supply control valve is mounted at the side surface of the upper mold and connects the supply line in the upper mold with an exterior cooling fluid supply line.

6. The mold of claim 1, wherein the supply control valve is an electric control solenoid valve of an on/off type.

7. The mold of claim 1, wherein the exhausting device is a pump.

8. The mold of claim 1, wherein the exhausting device is a fan.

9. The mold of claim 1, wherein the temperature detecting device comprises:

a sensor block inserted in a mounting groove formed from the side surface of the upper mold to a proximity of the cooling space;

a temperature sensor engaged to an inner end of the sensor block so as to contact an interior surface of the mounting groove and electrically connected to the controller;

a return spring mounted at the inner end of the sensor block and supported by the interior surface of the mounting groove; and a fixing bar neighboring the mounting groove, mounted at the side surface of the upper mold by a pin, and supporting an outer end of the sensor block.

10. The mold of claim 1, wherein the controller comprises a control logic operating the supply control valve and the exhausting device when the temperature signal of the temperature detecting device is higher than or equal to a predetermined value.

11. A mold for hot stamping comprising an upper mold and a lower mold so as to stamp a heated blank having a welding portion, wherein a recess is formed at an upper forming surface in the upper mold corresponding to the welding portion of the blank and defines a cooling space between the recess and the blank such that a cooling fluid directly cools the welding portion of the blank after the blank is stamped, wherein:

the blank having the welding portion is a tailor welded blank manufactured by welding boron steel plates having different thicknesses together;

the tailor welded blank is hot stamped such that the welding portion is formed at a boundary region of the boron steel plates;

the upper mold has an upper die and a lower die assembled with each other, laying recesses are respectively formed at confronting surfaces of the upper die and the lower die, and a coolant pipe for indirectly cooling the tailor welded blank is laid in the laying recesses;

the cooling space is the recess having a predetermined width formed at the upper forming surface of the lower die of the upper mold along the welding portion of the tailor welded blank; and the cooling fluid is supplied to the cooling space corresponding to the welding portion such that the cooling fluid directly contacts and cools the welding portion of the tailor welded blank in the cooling space after the tailor welded blank is stamped.

12. The mold of claim 11, wherein the cooling fluid is a coolant.

13. The mold of claim 11, wherein the cooling fluid is air.

14. The mold of claim 11, wherein the coolant pipe is formed with a repeating "S" shape.

15. The mold of claim 11, further comprising:

a supply control valve mounted at a side surface of the upper mold and adapted to supply a cooling fluid to the cooling space;

an exhausting device mounted at the other side surface of the upper mold and adapted to exhaust the cooling fluid from the cooling space;

a temperature detecting device mounted in the upper mold, detecting a temperature of the upper mold near the cooling space, and outputting a temperature signal; and a controller controlling the supply control valve and the exhausting device depending on the temperature signal output from the temperature detecting device.

16. The mold of claim 15, wherein the upper mold further comprises a supply line formed therein, and the supply control valve is mounted at the side surface of the upper mold and connects the supply line in the upper mold with an exterior cooling fluid supply line.

17. The mold of claim 15, wherein the supply control valve is an electric control solenoid valve of an on/off type.

18. The mold of claim 15, wherein the exhausting device is a pump.

19. The mold of claim 15, wherein the exhausting device is a fan.

20. The mold of claim 15, wherein the temperature detecting device comprises:

a sensor block inserted in a mounting groove formed from the side surface of the upper mold to a proximity of the cooling space;

a temperature sensor engaged to an inner end of the sensor block so as to contact an interior surface of the mounting groove and electrically connected to the controller;

a return spring mounted at the inner end of the sensor block and supported by the interior surface of the mounting groove; and a fixing bar neighboring the mounting groove, mounted at the side surface of the upper mold by a pin, and supporting an outer end of the sensor block.

21. The mold of claim 15, wherein the controller comprises a control logic operating the supply control valve and the exhausting device when the temperature signal of the temperature detecting device is higher than or equal to a predetermined value.

* * * * *